United States Patent [19]

Herbert et al.

[11] 3,979,080

[45] Sept. 7, 1976

[54] ANALOG AUTOMATIC SLOWDOWN SYSTEM

[75] Inventors: Roger B. Herbert; Harvey A. Horowitz, both of Williamsville; Donald F. Barrett, Buffalo, all of N.Y.

[73] Assignee: Westinghouse Electric Corporation, Pittsburgh, Pa.

[22] Filed: Mar. 27, 1975

[21] Appl. No.: 562,616

[52] U.S. Cl. ..... 242/78.6; 72/10; 242/67.5; 242/75.45

[51] Int. Cl.[2] ..... B21C 47/16; B21B 37/00

[58] Field of Search ..... 242/57, 78–78.6, 242/75.45, 75.51, 67.5; 72/8–12

[56] References Cited

UNITED STATES PATENTS

| | | | |
|---|---|---|---|
| 3,518,857 | 7/1970 | Hancock et al. | 72/8 |
| 3,553,992 | 1/1971 | Harbaugh | 72/9 |
| 3,663,806 | 5/1972 | Drankhan et al. | 242/75.51 |

*Primary Examiner*—Leonard D. Christian
*Attorney, Agent, or Firm*—James J. Wood

[57] ABSTRACT

An analog automatic slowdown control system is described for determining the optimum instant of time to initiate slowdown, for a process line in which a coil of material is being unwound from a mandrel at a linear speed. Using the intelligence derived from the linear speed and the speed of the unwind reel, signals are derived for: the instantaneous diameter, the desired remaining portion of the diameter after stopping, and the change in diameter during deceleration. These three signals are algebraically summed with a signal which is a function of the mandrel diameter, and when the summation is zero, slowdown is initiated.

5 Claims, 5 Drawing Figures

ANALOG AUTOMATIC SLOWDOWN SYSTEM

BACKGROUND OF THE INVENTION

1. Field of the Invention

The present invention relates to an analog system for automatic mill slowdown control.

2. Description of the Prior Art

In the operation of a rolling mill, as for example, a non-reversing tandem cold steel strip reduction mill, typically a strip of material is unwound from a payoff reel, threaded through the roll stands, and wound on a windup reel. When the threading operation is completed, the mill is accelerated from thread speed to a preselected run speed, and run at this speed until a point where mill deceleration is initiated to provide a safe tailoff, i.e. insure that the trailing end will not go through the mill at an excessive speed so as to endanger personnel as well as property. (Usually the tailoff speed is set equal to the thread speed.)

Similar operating conditions obtain in reversing type cold steel rolling mills as well as reversing rolling mills for materials other than cold steel strip. In the reversing type mill, a single roll stand is usually employed, and the start up procedure, run and slowdown sequence just described, is effected for each pass in the mill operation.

Obviously, in order to maximize productivity, it is desirable to run the mill at the highest possible speed and initiate slowdown at the latest point in time consonant with safety. If slowdown is begun too early, a wasteful amount of material will be processed at slow or thread speed. Optimum slowdown depends principally upon the operating run speed of the mill, and upon the number of strip wraps required on its payoff reel to enable mill deceleration to tailoff speed just as the strip tail end is coming off the payoff reel and entering the mill.

In those installations where a programmed digital computer is used for mill control a highly accurate selection and detection can be had of the slowdown payoff coil diameter for the purpose of optimizing the initiation of the slowdown signal. However, the utilization of a computer is not always economically feasible, so resort must be had to less expensive analog solutions.

One automatic slowdown control is described in U.S. Pat. No. 3,518,857 to C. O. Hancock et al for "Rolling Mill Automatic Slowdown Control." In this latter patent, the speeds of a payoff reel and an entry deflector roll respectively are compared. When the two speeds reach a predetermined relationship, mill slowdown is initiated. Control is adjustable as a function of strip gauge and mill speed to allow earlier mill slowdown for heavier gauge and/or faster mill run speed.

SUMMARY OF THE INVENTION

The automatic slowdown control system of this invention finds utility in a process line wherein a coil of material mounted on a mandrel is being unwound at a linear speed S, for determining the optimum instant of time to initiate slowdown. Means determine the instantaneous reel diameter to derive a signal $d$. Differentiating means receive the signal d and deliver a differential output $d'$. A signal $s$ is derived which is a function of the linear speed S, and a signal $n$ is derived which is a function of the unwind reel rotational speed. Means, receive the signals $d'$,s and deliver an output signal which is a function of $(d'/s)$, representative of the desired remaining portion of the reel diameter after stopping. Means are further provided for receiving the signals $d'$,$s$ and delivering an output which is a function of $d's$ representative of the change in the diameter of the material during deceleration. Algebraic summation means receive the signals $d$, functional signal d'/s and $d'$s, and an additional signal do which is a function of the mandrel diameter, and deliver an output signal to initiate slowdown when the algebraic summation of its inputs is zero.

MATHEMATICAL CONSIDERATIONS

Figure 2C:
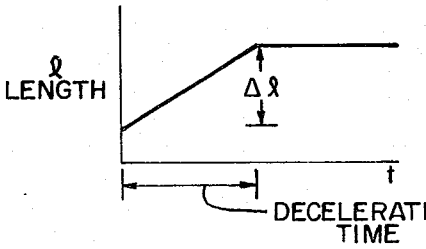
FIGS. 2A, 2B, 2C and 2D are views which are used in explaining the mathematical foundations of the invention.
Figure 2D:
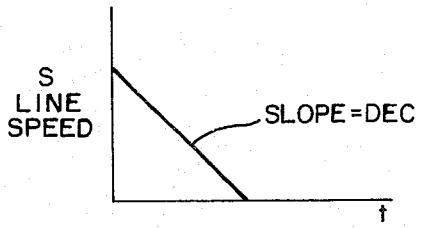
Figure 2B:
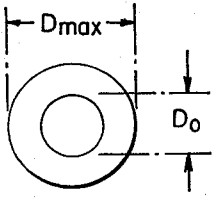
Figure 2A:
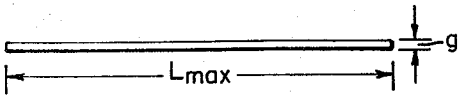

Referring now to FIGS. 2A and 2B, the coil to be unwound has an initial length Lmax and a strip thickness or gauge g which is wound in the form of a coil having a diameter Dmax, on a mandrel having a diameter Do. In developing the theory all linear units are in inches and time is in seconds. Later the various quantities will be converted into practical engineering units.

The edge areas of the strip material are equal, i.e.:

$$L_{max} \times g = \pi \left(\frac{D_{max}}{2}\right)^2 - \pi \left(\frac{Do}{2}\right)^2 \quad (1)$$

$$L_{max} \times g = \frac{\pi}{4} D_{max}^2 - Do^2 \quad (2)$$

Let $l$ = the length of strip payed out

D = the outside coil diameter after $l$ has been payed out.

$$L_{max}\, g - l\, g = \frac{\pi}{4}(D^2 - Do^2) \quad (3)$$

$$L_{max} - l = \frac{\pi}{4g}(D^2 - Do^2) \quad (4)$$

$$l = L_{max} - \frac{\pi}{4g}(D^2 - Do^2) \quad (5)$$

Let $S$ = line speed = $\frac{dl}{dt}$

Differentiating (5):

$$S = -\frac{\pi D}{2g}\frac{dD}{dt} \quad (6)$$

Solving for $g$ $$g = -\frac{\pi}{2S} D \frac{dD}{dt} \quad (7)$$

Near the end of the coil D ≈ Do $$g = -\frac{\pi}{2S} Do \frac{dD}{dt} \quad (8)$$

$$\frac{dD}{dt} = \frac{2Sg}{\pi Do} \quad (9)$$

A. DIAMETER REMAINING AFTER STOPPING ($\Delta D_1$)

Let W = the number of wraps remaining after stopping. (One wrap is defined as one layer of material.) Then the portion of the diameter ($\Delta D_1$) comprising the W wraps is 2Wg.

$$\Delta D_1 = 2Wg = \frac{-2W\pi}{2S} Do \frac{dD}{dt} \quad (10)$$

$$\Delta D_1 = \frac{-W\pi}{S} Do \frac{dD}{dt} \quad (11)$$

B. THE CHANGE IN DIAMETER DURING DECELERATION ($\Delta D_2$)

Referring now to FIGS. 2C and 2D, let $\Delta l$ = the length of strip payed out during a ramp deceleration from line speed S to zero at a deceleration rate = dec $\Delta l$ is the area under the curve (FIG. 2D) since $$\Delta l = \int_{\text{decel time}} (\text{linespeed})\, dt \quad (12)$$

$$\Delta l = \frac{1}{2} S \times \text{decel time} \quad (13)$$

$$\Delta l = \frac{1}{2} S \times \frac{S}{\text{dec}} \quad (14)$$

$$\Delta l = \frac{S^2}{2 \text{ dec}} \quad (15)$$

When slowdown is initiated, let the length and diameter of the material be $l$ and D respectively $$l = \frac{\pi}{4g}(D^2 - Do^2) \quad (16)$$

When the line stops $$l + \Delta l = \frac{\pi}{4g}[(D + \Delta D_2)^2 - Do^2] \quad (17)$$

$$l + \Delta l = \frac{\pi}{4g}[D^2 + 2D\Delta D_2 + \Delta D_2^2 - Do^2] \quad (18)$$

$(\Delta D_2)^2$ is small and may be ignored. Subtracting equation (16) from (18) gives:

$$\Delta l = \frac{\pi}{4g} 2D\Delta D_2 \quad (19)$$

$$\Delta D_2 = \frac{2\Delta l g}{\pi D} \quad (20)$$

$$g = \frac{\Delta D_2 \pi D}{2\Delta l} \quad (21)$$

Equating equations (7) and (21):

$$\frac{-\pi D}{2S} \frac{dD}{dt} = \frac{\Delta D \pi D}{2\Delta l} \quad (22)$$

$$\Delta l = \frac{-S\Delta D_2}{\frac{dD}{dt}} \quad (23)$$

Equating equations (15) and (23):

$$\frac{S^2}{2 \text{ dec}} = \frac{-S\Delta D_2}{\frac{dD}{dt}} \quad (24)$$

-continued $$\frac{S}{2 \text{ dec}} = \frac{-\Delta D_2}{\frac{dD}{dt}} \quad (25)$$

$$\Delta D_2 = \frac{-S}{2 \text{ dec}} \frac{dD}{dt} \quad (26)$$

CONVENTIONAL ENGINEERING UNITS

In conventional engineering practice the following units are employed:

a. D and Do are in inches
b. S is in ft/min
c. (dD/dt) = D′ and is in inches/second
d. dec is in (ft/min/sec) and
e. W is of course dimensionless $$S \left[\frac{\cancel{ft}}{\cancel{min}}\right] \times \frac{12 \text{ in}}{1 \cancel{ft}} \times \frac{1 \cancel{min}}{60 \text{ sec}} = S \left[\frac{\text{in}}{\text{sec}}\right]$$

Equation (11) becomes:

$$\Delta D_1 = -5W\pi Do \frac{D'}{S} \quad (27)$$

Equation (9) becomes:

$$D' = \frac{-2Sg}{5\pi Do} = \frac{-0.4Sg}{\pi Do} \quad (28)$$

Equation 26 is not affected by the mutually cancelling effect of ft/min in the S factor and the dec factor. The diameter D at which automatic slowdown should be initiated is:

$$D = D_{mandrel} + \Delta D_1 = \Delta D_2 \quad (29)$$

Substituting equations (26) and (27) in (29):

$$D = Do - 5W\pi Do \frac{D'}{S} \quad \frac{1}{2 \text{ dec}} D'S \quad (30)$$

In words, equation (30) states that automatic slowdown should be initiated at the diameter D equal to the diameter of the mandrel plus the decremental diameter to remain after the line speed stops (if the system is to decelerate the line to zero speed) plus the decremental diameter payed out during deceleration from run speed to zero (if the line has decelerated to a stop). It should be remembered that D′ is negative (the diameter is decreasing) so that each term on the right hand side of equation (30) is a positive number of inches.

MAGNITUDE SCALING FOR THE ELECTRICAL SYSTEM

The components utilized in the system presently to be described have a maximum voltage output of ± 10v. In the practical environment of the invention the excursions in magnitude of coil diameters, line speeds, and gauges are quite large so that an adjustment is required.

Let M = the maximum coil diameter in inches = 10v
$d$ = the voltage corresponding to a coil diameter
Then $$D = \frac{M}{10} d \quad (31)$$

Let P = the maximum mandrel diameter in inches = 10v do = the voltage corresponding to the mandrel diameter Then $$Do = \frac{P}{10} do \tag{32}$$

Let Q = the maximum rate of change of the diameter is (in/sec) = 10v. Q is computed from equation (28). $d'$ = the voltage corresponding to the rate of change of diameter Then $$D' = \frac{Q}{10} d' \tag{33}$$

Let U = the maximum line speed in ft/min = 10v and for the same line speed $$T = \frac{\text{payoff reel speed at full coil}}{\text{payoff reel speed at empty mandrel}}$$

$s$ = the voltage corresponding to line speed Then $$S = \frac{U^1}{10T} s \tag{34}$$

Let V = the payoff reel motor RPM at empty mandrel and maximum line speed = 10v

N = the actual payoff reel motor RPM n = the voltage corresponding to the payoff reel motor RPM Then $$N = \frac{V}{10} n \tag{35}$$

Substituting the relationships (31) (32) (33) (34) (35) in equation (30):

$$\frac{M}{10} d = \frac{P}{10} do - 5W\pi \frac{P}{10} do \frac{\frac{Q}{10} d'}{\frac{U}{10T} s} - \frac{\frac{U}{10T} s \frac{Q}{10} d'}{2 \text{ dec}} \tag{36}$$

In contemplation of this invention, the second term in the right hand side of the equation, the term (d'/s) will be computed by utilizing a divider which inherently multiplies the quotient by 10. In the third term on the right, the term $sd'$ will be computed by using a multiplier which inherently divides the product by 10. The equation which follows rearranges equation (36) to show these two signals in square brackets with an additional factor, i.e. 10 added to preserve the equality:

$$\frac{M}{10} d = \frac{P}{10} do - 5W\pi \frac{P}{10} do \frac{\frac{Q}{10}}{\frac{U}{10}} \frac{1}{10} \left[\frac{10Td'}{s}\right] - \frac{\frac{U}{10T} \frac{Q}{10} 10}{2 \text{ dec}} \left[\frac{sd'}{10}\right] \tag{37}$$

Simplifying:

$$\frac{M}{10} d = \frac{P}{10} do \frac{-W\pi PQdo}{20U} \left[\frac{10Td'}{s}\right] - \frac{UQ}{20T\text{dec}} \left[\frac{sd'}{10}\right] \tag{38}$$

Let $K_1 = (M/10)$ $K_2 = (P/10)$ $K_3 = (W\pi PQdo/20U)$ $K_4 = (UQ/20Tdec)$

Then $$K_1 d = K_2 do - K_3 \left[\frac{10Td'}{s}\right] - K_4 \left[\frac{sd'}{10}\right] \tag{39}$$

$$K_1 d - K_2 do + K_3 \left[\frac{10Td'}{s}\right] + K_4 \left[\frac{sd'}{10}\right] = 0 \tag{40}$$

The coefficients $K_1$, $K_2$, $K_3$ and $K_4$ are computed using the definitions given. Briefly it should be kept in mind that M and P are in inches, U is in ft/min and T is the ratio of the smallest mandrel diameter (in case there are two in use) to the maximum coil outside diameter. Q is the theoretical maximum magnitude of D' computed at the maximum line speed, maximum gauge, and minimum mandrel diameter (in the event there are two in use). It is not necessary to compute $K_3$ since it will usually be an operator adjustment, that is, the operator will dial in a voltage which is the analog of do. Some expected ranges for the coefficients are as follows:

$K_1$ 3.6 to 8.4

$K_2$ 1.6 to 3.0

$K_3$ 0.33 to 0.75 (assuming 10 wraps)

$K_4$ 0.177 to 42.6

DESCRIPTION OF A PREFERRED EMBODIMENT

Figure 1:
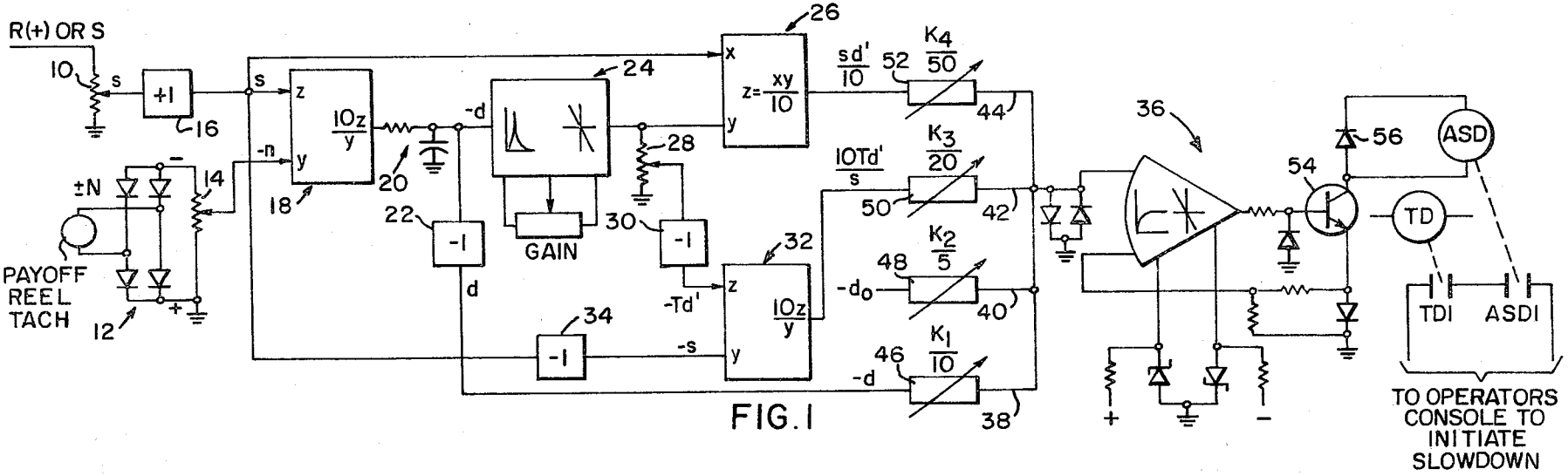
FIG. 1 is an electrical schematic of the automatic slowdown control system in accordance with the invention.

Referring now to FIG. 1, the line speed which must be positive is obtained from a line speed tachometer (not shown) or the line reference ramp signal (R+), and applied to a potentiometer 10. As indicated by the mathematics supra, the line speed signal is attenuated for equation scaling S to $s$.

The payoff reel RPM signal N is generally a voltage obtained from a tachometer which is applied to a diode bridge indicated generally at 12, the output of which is applied to a potentiometer 14. The RPM signal is a tachometer voltage which is attenuated and set to 10v at empty mandrel and top line speed, or if more convenient, set to a percentage of 10v corresponding to the percentage of maximum payoff reel RPM when the adjustment is being made. The polarity of the signal N does not matter since it is applied first to the rectifier diode bridge 12; thus applications requiring underwind and overwind are handled automatically.

The signal s is applied to an impedance transformation device 16 which may be 1:1 operational amplifier.

The signal s is applied as the dividend to a divider means indicated generally at 18. The quotient from divider 18 is applied to an RC filter network 20, and then to a −1 multiplier 22 and to a differentiating means 24. The differentiated output from rate detector means 24 is applied as one input to a multiplier indicated generally at 26, the other input to multiplier 26 being the signal s from the impedance transformation device 16.

The differentiated output from differentiator 24 is applied across a potentiometer 28, a portion of which is picked off by the wiper of the potentiometer and applied to an impedance transformation-inverting device or −1 multiplier 30. The output of the −1 multiplier 30 is applied as the dividend to a divider indicated generally at 32. The $+s$ signal from +1 multiplier 16 is applied to an impedance transformation-inverting device or −1 multiplier 34, the output of the latter being applied as a divisor to divider 32.

An algebraic summation means or comparator indicated generally at 36, has four inputs 38, 40, 42 and 44, the input containing proportional adjustment means or potentiometers shown symbolically at 46, 48, 50 and 52 respectively. The output of the comparator 36 is through the coil automatic slowdown relay ASD. The relay has normally open contacts ASD1. In series with contacts ASD1 are contacts TD1 of a time delay relay TD.

The comparator 36 is an operational amplifier arranged for algebraic summation as is well known in the art. It includes a driver transistor 54 and a suppressor diode 56 in parallel with coil ASD.

OPERATION

When the process line is ready and the operator wishes to utilize the automatic slowdown control system, a signal is given which energizes the time delay relay TD. This relay after a time delay of approximately 1 second closes contacts TD1. This delay is necessary because the outputs of the dividers 18, 32 are indeterminate before the line starts. The automatic slowdown control system is now enabled, but a signal will not be sent to the operator's console until relay ASD is energized closing contacts ASD1.

Each term of the equation (40) is an input to the algebraic summation means or comparator 36. As the process begins, $d$ is large and the term $K_1d$ dominates the summation process; this places the comparator 36 in negative saturation and the relay ASD is deenergized. As payoff continues, $d$ becomes smaller and $d'$ becomes larger. When equation (40) is finally realized, i.e. algebraic summation is zero; the comparator 36 switches to positive saturation; the relay ASD picks up, contacts the ASD1 close and a signal is sent to initiate slowdown.

The multiplier 26 performs the multiplication of the xy inputs and divides the product by 10, i.e. $(xy/10)$. The polarity of the output follows the normal rules of algebra.

The dividers 18, 32 perform the division and multiply the product by 10, i.e. $(10z/y)$. Several observations must be made. First, the numerator must not exceed the denominator or else the device will saturate. This is taken care of by making the maximum line speed not 10v, but instead equal to the payoff reel speed at full coil diameter. Secondly, the diameter obtained by dividing $(s/n)$ must be less than or equal to unity. Thirdly, the denominator must be negative.

The payoff reel RPM signal N is generally a tachometer voltage. It is attenuated and set equal to 10v at empty mandrel and top line speed, or if more convenient, set to a percentage of 10v corresponding to the percentage of maximum payoff reel RPM while making adjustment.

The transistor 54 provides sufficient current to drive the coil ASD. The diode 56 in parallel with the coil ASD suppresses the inductive transient. When the coil ASD drops out, current flows out of the bottom of the coil (as viewed in FIG. 1) through the diode 56, and the voltage drop is limited by the forward drop across the diode.

We claim:

1. In a process line wherein a coil of material mounted on a mandrel driven by a payoff reel motor, is being unwound at a linear speed S, an analog automatic slowdown control system for determining the optimum instant of time to initiate slowdown of the material being payed out, comprising:

a. means for determining the instantaneous diameter of the coil of material to derive a signal $d$;

b. means for differentiating, connected to receive said signal d and deliver a signal $d'$, where $d'$ is the derivative of the instantaneous diameter d with respect to time;

c. means for deriving a signal s which is a function of said linear speed;

d. means for deriving a signal n which is a function of the speed of the payoff reel motor;

e. means for determining the desired remaining portion of the coil diameter after stopping, adapted to receive said signals $d'$, $s$, and to deliver an output signal which is a function of $(d'/s)$;

f. means for determining the change in the diameter of the coil of material during deceleration adapted to receive said signals $d'$, $s$, and to deliver an output signal which is a function of $d'$, $s$;

g. means for deriving an analog signal do which is a function of the diameter of said mandrel, and h. means for summation adapted to receive the signals: $d$, do, functional signals $(d'/s)$ and $d's$, and to deliver an initiation signal to begin slowdown when the signal $d$ equals the sum of said other signals.

2. An analog automatic slowdown system according to claim 1 wherein said means for determining the instantaneous diameter d comprises divider means for accepting $s$ as a dividend and $n$ as a divisor and for delivering the quotient $d$ as an output.

3. An analog automatic slowdown system according to claim 1 wherein said means for determining the desired remaining portion of the coil diameter after stopping comprises divider means for receiving said function of $d'$ as a dividend and said signal $s$ as a divisor and for delivering as a quotient said function of $(d'/s)$.

4. An analog automatic slowdown system according to claim 1 wherein said means for determining the change in the diameter of the coil of material during deceleration comprises multiplier means for receiving said signals $s$ and $d'$ and for delivering their product as a function of $sd'$.

5. An analog automatic slowdown system according to claim 1 wherein said summation means comprises an operational amplifier.

* * * * *